United States Patent [19]

Tag et al.

[11] Patent Number: 4,500,369

[45] Date of Patent: Feb. 19, 1985

[54] EMULSION EXPLOSIVE

[75] Inventors: Arne Tag; Bjorn R. Petterson, both of Oslo; Erik C. Nygaard, Porsgrunn, all of Norway

[73] Assignee: Norsk Hydro a.s., Oslo, Norway

[21] Appl. No.: 561,206

[22] Filed: Dec. 14, 1983

[30] Foreign Application Priority Data

Dec. 23, 1982 [NO] Norway ..... 824351

[51] Int. Cl.[3] ..... C06B 45/00

[52] U.S. Cl. ..... 149/2; 149/21; 149/46; 149/61; 149/109.6

[58] Field of Search ..... 149/2, 21, 46, 61, 109.6

[56] References Cited

U.S. PATENT DOCUMENTS

| | | | |
|---|---|---|---|
| 4,310,364 | 1/1982 | Ekman et al. | 149/2 |
| 4,315,787 | 2/1982 | Hattori | 149/2 |
| 4,338,146 | 7/1982 | Granlund | 149/2 |

FOREIGN PATENT DOCUMENTS 7811001 7/1978 Sweden .

*Primary Examiner*—Stephen J. Lechert, Jr.

*Attorney, Agent, or Firm*—Wenderoth, Lind & Ponack

[57] ABSTRACT

The present invention relates to an emulsion explosive of the water-in-oil type having resistance against dissolution in water, and application of said emulsion in explosive mixtures. The emulsion explosive is non capsensitive and can be cartridged alone or in mixture with ANFO. It can also be used in bulk systems. The explosive contains 60–90 percent by weight of ammonium nitrate and calcium nitrate, 4–15 percent by weight of a crystallization temperature lowering agent, preferably urea, and 2–6% wax and/or a wax/oil mixture. The content of water consists essentially of water of crystallization bound to the calcium nitrate. Further, the explosive contains emulsifier and density reducing agents such as sodium nitrite/thiourea or hollow microspheres.

9 Claims, 1 Drawing Figure

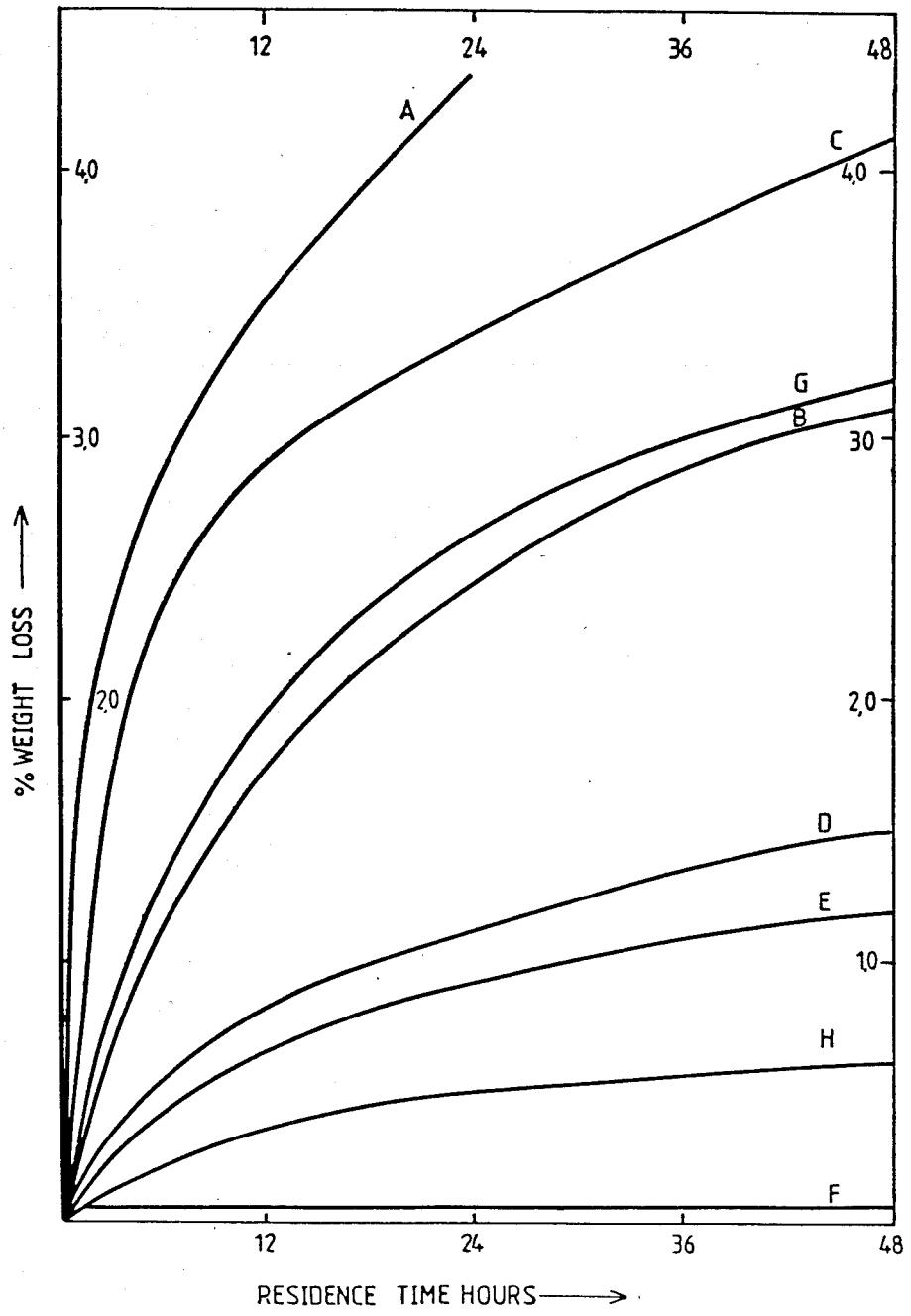
12
24
36
48
A
C
4,0
4,0
G
B
3,0
30
% WEIGHT LOSS
2,0
2,0
D
E
1,0
H
F
12
24
36
48
RESIDENCE TIME HOURS

EMULSION EXPLOSIVE

The present invention relates to an emulsion explosive of the water-in-oil type having high resistance against dissolution in water, and application of said emulsion in explosive mixtures. The emulsion explosive comprises ammonium nitrate and calcium nitrate as oxidant and an agent which lowers the crystallization temperature of the oxidant mixture, and also water, emulsifier, a density reducing agent and a hydrocarbon fuel.

There is an increasing need for improved, high energy and effective explosives, especially in the mining and construction fields. In recent years there has been several types of explosives to choose from. One explosive which is used, is ANFO (Ammonium Nitrate Fuel Oil), which mainly consists of free-flowing ammonium nitrate particles impregnated with a few percent oil. One property of this explosive which has limited its application, is its poor water resistance.

Water which penetrates into the bore holes has, however, always been a problem also when other types of explosives are used. Therefore it has for a long time been tried to manufacture water resistant explosives which at the same time have a high blasting effect and low production costs.

In the 1960s and 70s there was a break-through on the American market for the so-called water gel explosives and emulsion explosives. These explosives are water based (10–20% $H_2O$) and do not have the main characteristics of ANFO, that is pneumatic loading. These new explosives must accordingly be loaded in the bore holes by pumping or in form of packages. Water gel and emulsion explosives are better than ANFO regarding their resistance against dissolution and being washed out by water.

In recent years the so-called inverted emulsions (water-in-oil) have dominated the development within water based explosives. These consist generally of a continuous hydrocarbon phase and a discontinuous, dispersed aqueous phase of oxygen releasing components. Some emulsion explosives contain additives which contribute to increasing the sensitivity and the energy content.

Within the emulsion explosive field there is known from Swedish Pat. No. 78.11001 a non cap sensitive explosive which is stated to have relatively good storing properties and water resistance. According to the example of the patent ammonium nitrate, calcium nitrate and sodium nitrate are applied as oxygen releasing components, and the explosive further contains 3–6% free water, 3–5% urea, 4–6% oil, emulsifier and microspheres of glass. According to the patent the explosive is intended for pipe loading, and accordingly it has a relatively low energy content.

Swedish Pat. No. 78.11002 relates primarily to production techniques for a non cap sensitive emulsion explosive having the same components as the above mentioned pipe loading explosive.

The object of the present invention was to arrive at a water resistant emulsion explosive having a relatively high content of energy and which was economical to manufacture and easy to load in bore holes.

A further object was to manufacture an emulsion explosive having ammonium nitrate (AN) and calcium nitrate (CN) as the primary oxygen releasing components.

These objects are achieved by providing an emulsion explosive of the water-in-oil type having high resistance against water, comprising ammonium nitrate, calcium nitrate, water, a crystallization temperature lowering agent, emulsifier, density reducing agent and a hydrocarbon fuel, characterized in that the explosive contains 60–90 percent by weight of ammonium nitrate and calcium nitrate 4–15 percent by weight of crystallization temperature lowering agent, preferably urea, and as hydrocarbon fuel wax, oil or a wax/oil mixture in amounts of 2–6 percent by weight, and that the content of water substantially consists of water of crystallization bound to the calcium nitrate.

Preferably, the emulsion explosive contains 35–45 percent by weight of ammonium nitrate, 35–45 percent by weight calcium nitrate, inclusive of water of crystallization, and 10–12 percent by weight of urea, and the hydrocarbon fuel consists essentially of wax having a melting point of 30°–60° C.

Some of the known emulsion explosives have relatively high water resistance, but their energy content and sensitivity are substantially reduced because of the incorporated water which in addition requires energy for evaporation during the blasting.

The inventors decided to develop an emulsion explosive, but one having a higher energy content than those known in the field. It was desired to arrive at an explosive which could be cartridged or used as a pumpable emulsion, alone or in mixture with ANFO.

As a starting point it was found necessary to study five parameters:

1. Water resistance
2. Storage stability
3. Emulsifying temperature
4. Propagation properties/coupling effect
5. Pressure sensitivity In order to have a basis for comparison during the further experiments, a known explosive was tested with respect to water resistance.

The known explosive, here called A, corresponds to those described in Swedish Pat. Nos. 78.11001 and 78.11002. The preliminary tests showed that explosive A dissolved easily in water, and after 48 hours the weight loss was 8,1 weight percent. The inventors knew that wax had been used for protecting explosives against water. It was tried to apply wax partly or wholly as a fuel component. It was, however, found that it was quite difficult to emulgate the oxidizer into the wax.

It was desired to apply an oxidant mixture having a low crystallization point. During manufacture of water based explosives this is in most cases achieved by addition of water. Emulsification of such a solution with wax would, however, result in an explosive having a lower content of energy than desired. In order to lower the crystallization temperature of the oxidant mixture, it was tried to add to these agents some urea, for instance as described in the above cited Swedish patent descriptions. Several mixtures of ammonium nitrate, calcium nitrate and urea, together with varying amounts of water, were prepared. Reference to calcium nitrate (CN) in this application means calcium nitrate of technical quality, and it can be defined as $5Ca(NO_3)_2.NH_4NO_3.10H_2O$. This product contains about 6% AN, about 79 weight percent calcium nitrate and about 15 weight percent water bound as water of crystallization. It was found that oxidant mixtures having a crystallization temperature which was very low, for instance 60° C., could be obtained even when the amount of free water was equal to zero. Attempts were made to emulgate said mixtures into oil and/or wax. By using only wax as fuel, in addition to the present urea, it was found that it was necessary to use special types of wax. It was, however, possible to emulgate a mixture consisting of ammonium nitrate, calcium nitrate, urea and wax together with an emulsifier. During the preliminary tests of the water resistance of these mixtures, it was found that it was possible to produce an emulsion explosive of the water-in-oil type, but without any free water present. The explosives will, however, contain some water because the calcium nitrate used contains water of crystallization. Theoretically, such an explosive should have a high content of energy as its total content of water is low. The question then was whether such an explosive would react positively in the test of the other parameters mentioned above.

In order to investigate the further properties of the explosives, different type of density reducing agents were added to the test mixtures. Use was made of gasifying agents like sodium nitrite together with thiourea. Glass microspheres were added to some of the samples in order to lower the density of the explosive and to increase its sensitivity, as the gas bubbles or the hollow glass spheres act as so-called "hot spots".

As the preliminary experiments had shown that application of oil as fuel in the explosive resulted in lower water resistance than when wax was used as fuel, it was necessary to study closer which types of wax could be used. The properties demanded of the wax were partly incompatible. Investigation of applicable types of wax showed that petroleum wax having a melting point between 30° and 60° C. should preferably be used.

The further experiments showed that application of a special ratio between AN, CN and urea, and application of only wax as primary fuel instead of the usual oil, produced an explosive having unexpectedly high resistance against water. It should be noticed that here urea acts both as a crystallization temperature lowering agent and as fuel. By regulating the addition of density reducing agents, known per se, one obtained also good propagation properties and good performance at high static pressure. The new explosive had also a substantially higher content of energy than the known emulsion explosives, not containing special additives as Al for increasing the energy content, and in this respect the new explosive was indeed comparable with ANFO explosives. The invention will now be further explained in connection with the examples which show preparation and testing of several types of water-in-oil emulsion explosives. The oxidants were first mixed with water and/or urea and kept at a temperature just above the crystallization temperature of the nitrate solution. The different emulsion explosives were cartridged in polyethylene film, and each cartridge weighed about 600 g and had a diameter of about 50 mm.

EXAMPLE 1

This example shows the water resistance of the explosives exposed to circulating water. Cartridges which had been cut up were placed in a pipe of about 60 mm through which flowed 2 l of water per hour. Use was made of two types of wax, type I which had a melting point of about 38° C. and an oil content of 15–20% and type II which had a melting point of 58° C. and an oil content of 10%. The amount of the components are stated in weight percent. The abbreviation SN refers to sodium nitrate.

0,5% of sorbitan fatty acid ester as emulsifier was added to all the explosives.

The following nine explosives were tested:

TABLE 1

| Explosive | AN | CN | Urea | Free water | Wax | Weight loss % |
|---|---|---|---|---|---|---|
| A* | 38 | 39 | 5 | 4 | 5 (oil) | 8,1 |
| B* | 38 | 39 | 5 | 4 | 5 | 3,1 |
| C | 58 | 20 | 0 | 14 | 8 (I) | 4,1 |
| D | 40,5 | 40,5 | 0 | 11,0 | 8 (I) | 1,5 |
| E | 40,5 | 40,5 | 0 | 11,0 | 8 (I + II) | 1,2 |
| F | 41,8 | 41,8 | 11,4 | 0 | 5 (I + II) | 0,08 |
| G | 41,8 | 41,8 | 5,7 | 5,7 | 5 (I + II) | 3,2 |
| H | 45,1 | 45,1 | 4,8 | 0 | 5 (I + II) | 0,6 |
| I | 40,4 | 40,4 | 14,2 | 0 | 5 (I + II) | ** |

*Explosive A also contained 9 parts by weight of sodium nitrate (SN) and 5 parts by weight of hollow glass spheres.

**Explosive I could not be emulsified when the emulsifier stated below was applied.

Explosives C-I also contained 0,1% sodium nitrite and 0,3% thiourea.

The last column in the table gives the weight loss in percent, i.e. that part of the explosive which was dissolved in circulating water during 48 hours. A high value for "weight loss" shows poor water resistance. Thus the water resistance of explosive F according to the invention will be 100 times higher than for explosive A. Also explosive H, according to the invention, has far higher water resistance than the known explosives A and B, and the explosives C-E which are outside the scope of the present invention. It is emphasized that the weight loss of explosive F is stabilized after 5 hours while for explosive H it increases slowly in about 18 hours, whereupon it is substantially constant.

In the drawing, the weight loss in percent for the different explosives is shown as a function of time. As is shown by the FIGURE, the weight loss for the other explosives will level out on a far higher level and increase quite strongly as a function of time.

The water resistance in stagnant water was also tested. The relative ratio between water resistance for explosives A-H was substantially the same as during the test in circulating water. This test accordingly confirmed that explosives of the invention have a very high water resistance which is far better than for the known explosives.

As the investigations regarding water resistance resulted in such good results for explosive F, further investigations of the other parameters for this explosive were started and the storage stability was studied first. The experiments were carried out by cycling cartridges between +20° C. and −18° C. The residence time was about 8 hours at −18° C. and about 16 hours at 20° C. All in all there were 20 cyclings. Visually it was not possible to notice any difference between the cartridges which had been stored at +20° C. and those which had been exposed to temperature cycling. All samples seemed homogeneous and without any sign of phase separation.

It was also found that the crystal structure of a mixture of ammonium nitrate and calcium nitrate was substantially altered by introduction of urea. When 44 parts by weight of AN were mixed with 44 parts by weight of CN and 12 parts by weight of free water, one got a mixture which crystallized at 38° C. and which upon storage at room temperature became relatively hard. However, if the 12 parts by weight of water were substituted with as many parts by weight of urea, the crystallization temperature increased to 59° C., and this new mixture had a porridge like consistency when stored at room temperature. By applying urea instead of free water one can get an oxidant mixture or nitrate solution which does not become hard at room temperature and which accordingly can be transported by pumping and mixed with other components, for instance a hydrcarbon fuel, and thus get an emulsion explosive.

Investigations of propagation properties/coupling effect and pressure sensitivity for explosives according to the invention showed that it has possible to obtain good results for these parameters by choosing the correct density reducing agent. When the explosive shall be cartridged, it will in most cases be an advantage to use hollow glass spheres as density reducing agent. The following example shows detonation tests of an explosive according to the invention.

EXAMPLE 2

An explosive having the following properties and composition in weight percent was detonated in steel pipes of 36 mm and 54 mm.

| | |
|---|---|
| AN | 41,80% |
| CN | 41,80% |
| Urea | 11,01% |
| Emulsifier | 0,30% |
| Thiourea | 0,30% |
| Sodium nitrite | 0,10% |
| Oil | 4,69% |
| Density | 1200 g/l |
| Oxygen balance | 0,05% |
| Gas volume | 818 l/kg |
| Heat of explosion | 3023 kJ/kg |

The detonation test gave the following result:

| |
|---|
| Diameter = 36 mm, Detonation speed = 4500 m/s |
| Diameter = 54 mm, Detonation speed = 5000 m/s |

It was also confirmed that the explosive was non cap-sensitive.

EXAMPLE 3

This example shows application of an emulsion explosive according to the invention in an explosive mixture.

First an emulsion was made having the following composition in weight percent:

| | |
|---|---|
| AN | 41,58% |
| CN | 41,58% |
| Urea | 11,34% |
| Oil | 5,00% |
| Emulsifier | 0,50% |
| Density | 1550 g/l |

ANFO (about 94% ammonium nitrate and 6% oil) was added to the above emulsion in such amounts that the mixture had the following composition:

| | |
|---|---|
| Emulsion | 46% |
| ANFO | 54% |
| Density | 1440 g/l |

Detonation tests for this mixture were carried out in ten bore holes having diameters of 165,1 mm and a length of 14 m. Stable detonations were surprisingly recorded in all the bore holes in spite of the fact that the explosive mixture had a density as high as 1440 g/l and no density reducing or "hot spot" forming agents like microspheres were used. Compared to corresponding mixtures of ANFO with other emulsion explosives, the mixture according to the invention differs significantly from the known mixtures by being detonatable even when having a high density.

Though density reducing agents proved to be unnecessary, it is within the scope of the invention to incorporate such agents in the mixture for further improvement of the sensitivity. The ratio between emulsion and ANFO can be varied within wide limits. However, the ratio emulsion:ANFO should preferably be 40–60 to 60–40.

By production of explosives to be used in bulk, it is possible to apply regulated gasing during filling of the bore hole, and this will reduce the problem of high pressure sensibility. One can for instance add a large quantity of gasifiers at the bottom and then reduce the addition as the hole get filled. Also, with explosives for application in bulk, one can apply glass spheres.

The explosive according to the invention can, as stated above, be produced by applying sorbitan fatty acid ester as emulsifier, but also other emulsifiers known in the water-in-all explosives field can be used.

As oxygen releasing components in the explosive according to the invention, it has been found to be most advantageous to use ammonium nitrate and calcium nitrate. However, it will be within the scope of the invention that the oxygen releasing nitrate solution or melt which can be emulsified with wax also contains other oxygen releasing alkali or alkali earth salts. The essential requirement is that one has an emulsifiable melt or solution having a very low content of free water, preferably equal to zero.

Urea is found to be the most suitable agent for lowering the crystallization temperature of the nitrate solution and at the same time giving an emulsifiable solution or melt. The explosive according to the invention can contain 4–15% urea, preferably 10–12 weight percent. Application of similar agents which give similar effect as urea, will also be within the scope of the invention.

As can be seen from the above examples, one has by the present method arrived at a new emulsion explosive having a far higher water resistance than known emulsion explosives. In addition, the new explosives fulfil the usual requirements of initiator properties, detonation speed, storing properties etc. It is also applicable in explosive mixtures containing ANFO.

The explosive can be packed in different cartridge diameters, alone or in mixture with for instance ANFO. It can also be used when loaded in pipes. Further one can apply the explosive in bulk systems.

We claim:

1. An emulsion explosive of the water-in-oil type comprising:
   - a total of 60–90 percent by weight of both ammonium nitrate and calcium nitrate;
   - 4–15 percent by weight of a crystallization temperature lowering agent;
   - an emulsifier;
   - a density reducing agent; and
   - 2–6 percent by weight of at least one hydrocarbon fuel selected from the group consisting of wax and oil;
   - wherein the content of water in said explosive substantially consists of water of crystallization bound to said calcium nitrate.

2. Emulsion explosive according to claim 1, containing 35–45 percent by weight of ammonium nitrate, 35–45 percent by weight of calcium nitrate, inclusive of water of crystallization, and 10–12 percent by weight of urea, and wherein the hydrocarbon fuel consists essentially of wax having a melting point of 30°–60° C.

3. Explosive according to claim 1, wherein the density reducing agent is (1) sodium nitrate and thiourea as gasifying agent or (2) hollow glass microspheres.

4. Emulsion explosive according to claim 1, wherein the crystallization temperature lowering agent is urea.

5. Explosive according to claim 2, wherein the density reducing agent is (1) sodium nitrite and thiourea as gasifying agent or (2) hollow glass microspheres.

6. An explosive mixture comprising the emulsion explosive of claim 1 and ammonium nitrate fuel oil.

7. Explosive mixture according to claim 6, containing 40–60 percent by weight of the emulsion explosive and 40–60 percent by weight of the ammonium nitrate fuel oil.

8. A method of preparing an explosive mixture which comprises mixing an emulsion explosive of the water-in-oil type and ammonium nitrate fuel oil, said emulsion explosive comprising a total of 60–90 percent by weight of both ammonium nitrate and calcium nitrate;

4–15 percent by weight of a crystallization temperature lowering agent;

an emulsifier;

a density reducing agent; and

2–6 percent by weight of at least one hydrocarbon fuel selected from the group consisting of wax and oil;

wherein the content of water in said explosive substantially consists of water of crystallization bound to said calcium nitrate.

9. Method according to claim 8, wherein the emulsion explosive and ammonium nitrate fuel oil are mixed in a ratio of 40–60 percent by weight of the emulsion explosive and 40–60 percent by weight of the ammonium nitrate fuel oil.

* * * * *